US012529118B2

(12) United States Patent
Arita et al.

(10) Patent No.: US 12,529,118 B2
(45) Date of Patent: Jan. 20, 2026

(54) HOT ROLLED STEEL SHEET FOR NON ORIENTED ELECTRICAL STEEL SHEET AND PRODUCING METHOD THEREOF

(71) Applicant: NIPPON STEEL CORPORATION, Tokyo (JP)

(72) Inventors: Yoshihiro Arita, Tokyo (JP); Takeru Ichie, Tokyo (JP); Fuminobu Murakami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 356 days.

(21) Appl. No.: 18/276,623

(22) PCT Filed: Feb. 19, 2021

(86) PCT No.: PCT/JP2021/006320

§ 371 (c)(1),
(2) Date: Aug. 9, 2023

(87) PCT Pub. No.: WO2022/176154

PCT Pub. Date: Aug. 25, 2022

(65) Prior Publication Data

US 2024/0093322 A1 Mar. 21, 2024

(51) Int. Cl.

| | |
|---|---|
| ***C21D 8/12*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 8/1222* (2013.01); *C21D 9/46* (2013.01); *C22C 38/004* (2013.01); *C22C 38/02* (2013.01); *C22C 38/04* (2013.01); *C22C 38/06* (2013.01)

(58) Field of Classification Search
None
See application file for complete search history.

(56) References Cited

U.S. PATENT DOCUMENTS

2014/0238558 A1 8/2014 Fujikura et al.

FOREIGN PATENT DOCUMENTS

| | | | | |
|---|---|---|---|---|
| CN | 104438328 | A | | 3/2015 |
| JP | 4-6220 | A | | 1/1992 |
| JP | 2000226616 | A | * | 8/2000 |
| JP | 2010-242186 | A | | 10/2010 |
| JP | 6620522 | B2 | | 12/2019 |
| WO | WO 2013/069754 | A1 | | 5/2013 |

* cited by examiner

*Primary Examiner* — Anthony M Liang
(74) *Attorney, Agent, or Firm* — Birch, Stewart, Kolasch & Birch, LLP

(57) ABSTRACT

A hot rolled steel sheet is for a non oriented electrical steel sheet, wherein vickers hardness at the widthwise edge is 180 Hv or more, a value obtained by subtracting a vickers hardness at the widthwise center from the vickers hardness at the widthwise edge is 10 to 100 Hv, ductile brittle transition temperature at the widthwise edge is 0° C. or less, a value obtained by subtracting the ductile brittle transition temperature at the widthwise edge from a ductile brittle transition temperature at the widthwise center is 10 to 100° C., and a value obtained by subtracting a sheet thickness at the widthwise edge from a sheet thickness at the widthwise center is 50 μm or less.

5 Claims, No Drawings

HOT ROLLED STEEL SHEET FOR NON ORIENTED ELECTRICAL STEEL SHEET AND PRODUCING METHOD THEREOF

TECHNICAL FIELD

The present invention relates to a hot rolled steel sheet for a non oriented electrical steel sheet and a producing method thereof.

BACKGROUND ART

In recent years, due to the increasing worldwide demand for energy saving in electrical equipment, it is required to further improve the performance of non oriented electrical steel sheets used as core materials for rotating machines.

For high-efficiency motors among electrical products, high grade non oriented electrical steel sheets are often used. In general, for the high grade non oriented electrical steel sheets, electrical resistance are increased by increasing Si and Al content, and grain size is controlled to be coarse.

However, since the production cost for the high grade non oriented electrical steel sheets is higher, it is required to further reduce the production cost therefor. In order to reduce the cost, it is important to simplify the producing process.

Self-annealing conducted during cooling after hot rolling is a technique which can be anticipated to omit hot-rolled sheet annealing. The purpose of hot-rolled sheet annealing is to promote recrystallization and grain growth of the hot-rolled sheet. By the hot-rolled sheet annealing, it is possible to solve the problem of shape defect called ridging and to improve the magnetic characteristics. In the self-annealing, it is tried to obtain the above effect of hot-rolled sheet annealing by the temperature of the hot-rolled coil itself during cooling after hot rolling. The techniques of self-annealing are disclosed as follows.

For instance, Patent Document 1 discloses the technique of self-annealing in which the coiling temperature after hot rolling is controlled to be 780° C. or higher for the non oriented electrical steel sheet with excellent magnetic flux density in which 0.005% or less of C, 0.1 to 2.0% of Si, 0.05 to 0.6% of Mn, and 0.5% or less of Al are included in unit of mass % and the number density of AlN with an average diameter of 10 to 200 nm is specified.

Patent Document 2 discloses the technique to omit the hot-rolled sheet annealing in which 0.008% or less of C, 2 to 3% of Si and Al in total, 0.02 to 1.0% of Mn are included in unit of mass %, 0.3 to 0.5% of Al/(Si+Al) is satisfied, the final rolling temperature in hot rolling is controlled to be 1050° C. or more, the time not to inject water thereafter is controlled to be 1 to 7 seconds or less, and the water cooling is conducted to 700° C. or less for coiling.

Patent Document 3 discloses the method for producing the non oriented electrical steel sheet with excellent magnetic flux density and excellent iron loss in which 0.010% or less of C, 0.1 to 2.0% of Si, 0.1 to 1.5% of Mn, 0.1 to 1.0% of Al, 0.02 to 0.20% of Sn, 0.1 to 1.0% of Cu are included in unit of mass % and the hot-rolled sheet annealing or the self-annealing is conducted at a temperature below the Ac1 transformation point.

RELATED ART DOCUMENTS

Patent Documents

[Patent Document 1] PCT International Publication No. WO2013/069754

[Patent Document 2] Japanese Unexamined Patent Application, First Publication No. 2010-242186

[Patent Document 3] Japanese Unexamined Patent Application, First Publication No. H04-6220

SUMMARY OF INVENTION

Technical Problem to be Solved

The conventional techniques described above are to promote the grain growth of the hot rolled steel sheet by self-annealing while omitting the hot-rolled sheet annealing, and thereby to improve the magnetic characteristics. However, when trying to replace hot-rolled sheet annealing with self-annealing after hot rolling, it has been found that the steel sheet tends to fracture in the pickling process in which repeated bending is applied to the steel sheet plural times. For this reason, the conventional techniques described above have a problem that the merit of omitting hot-rolled sheet annealing is not sufficiently obtained.

The present invention has been made in consideration of the above mentioned situations. An object of the invention is to provide a hot rolled steel sheet for a non oriented electrical steel sheet which achieves stable passability without fracture of the steel sheet in the pickling process, and a producing method thereof.

Solution to Problem

An aspect of the present invention employs the following.

(1) A hot rolled steel sheet for a non oriented electrical steel sheet according to an aspect of the present invention, the hot rolled steel sheet includes, as a chemical composition, by mass %, 0.0050% or less of C, 1.9 to 3.5% of Si, 0.10 to 1.50% of Mn, 0.10 to 1.50% of Al, and a balance consisting of Fe and impurities, wherein, when a widthwise edge is a 25 mm position from an edge of a steel sheet in a transverse direction and when a widthwise center is a center position of the steel sheet in the transverse direction, a vickers hardness at the widthwise edge is 180 Hv or more, ΔHv which is a value obtained by subtracting a vickers hardness at the widthwise center from the vickers hardness at the widthwise edge is 10 to 100 Hv, a ductile brittle transition temperature at the widthwise edge is 0° C. or less, ΔDBTT which is a value obtained by subtracting the ductile brittle transition temperature at the widthwise edge from a ductile brittle transition temperature at the widthwise center is 10 to 100° C., and a value obtained by subtracting a sheet thickness at the widthwise edge from a sheet thickness at the widthwise center is 50 μm or less.

(2) A producing method of the hot rolled steel sheet for the non oriented electrical steel sheet according to the above (1), the method may include heating a slab to 1050 to 1180° C., the slab including, as a chemical composition, by mass %, 0.0050% or less of C, 1.9 to 3.5% of Si, 0.10 to 1.50% of Mn, 0.10 to 1.50% of Al, and a balance consisting of Fe and impurities, rough-rolling the slab after the heating, reheating a rough-rolled sheet after the rough-rolling, final-rolling the rough-rolled sheet after the reheating under conditions such that a final temperature is 900 to 1000° C., and coiling a final-rolled sheet after the final-rolling under conditions such that a coiling temperature at the widthwise edge is 700 to 800° C., and the coiling temperature at the widthwise edge is 50° C. or less as compared with a coiling temperature at the widthwise center.

(3) In the producing method of the hot rolled steel sheet for the non oriented electrical steel sheet according to the above (2), a bottom surface of a coiled sheet after hot rolling may be made not to contact with another coiled sheet for at least 30 minutes after the coiling.

Effects of Invention

According to the above aspects of the present invention, it is possible to provide the hot rolled steel sheet for the non oriented electrical steel sheet which achieves stable passability without fracture of the steel sheet in the pickling process, and the producing method thereof. In addition, according to the above aspects of the present invention, it is possible to suppress scratches and dent flaws at an edge in the transverse direction of the coiled sheet after hot rolling.

DETAILED DESCRIPTION OF PREFERRED EMBODIMENTS

Hereinafter, a preferable embodiment of the present invention is described in detail. However, the present invention is not limited only to the configuration which is disclosed in the embodiment, and various modifications are possible without departing from the aspect of the present invention. In addition, the limitation range as described below includes a lower limit and an upper limit thereof. However, the value expressed by "more than" or "less than" does not include in the limitation range. Unless otherwise noted, "%" of the amount of respective elements expresses "mass %".

The present inventors have investigated the reason why a steel sheet tends to fracture in a pickling process when self-annealing is conducted in a hot rolling process and hot-rolled sheet annealing is omitted. In particular, the investigation has focused on conditions of an edge in a transverse direction of a coiled sheet after hot rolling and material properties. As a result, the present inventors have found that scratches and dent flaws are formed during conveyance at the edge in the transverse direction of the coiled sheet after hot rolling, bending deformation is applied to the steel sheet during passing plural rolls in the pickling process, strain at the time is concentrated on the scratches and the dent flaws, and thereby, a crack is initiated and propagated to fracture.

The present inventors have made a thorough investigation to suppress the sheet fracture (fracture of steel sheet) which occurs in the pickling process as explained above. The findings are shown below.

When a final-rolled sheet is coiled into a coil shape after final rolling in the hot rolling process, irregular coiling may often occur. In addition, when the coil after coiling is transported on a conveyer under condition such that a coiling axis of the coil is vertical (under condition such that a core of the coil becomes a vertical hole), the scratches tend to be formed in an area where the irregular coiling occurred on a undersurface of the coil (bottom surface under the coil). Also, when the coil is lifted by a crane under condition such that the coiling axis of the coil is horizontal (under condition such that the core of the coil becomes a horizontal hole), the dent flaws tend to be formed by contacting a crane hook to the coil face.

In order to suppress the fracture of the steel sheet in the pickling process, it is needed to optimally minimize the scratches and the dent flaws which are formed on the coiled sheet after hot rolling. In addition, the steel sheet needs to have toughness such that the steel sheet does not fracture even when the strain is concentrated on the scratches and the dent flaws.

Firstly, the present inventors have found that, in order to reduce the scratches and the dent flaws, vickers hardness is controlled to be 180 Hv or more at a 25 mm position from an edge of a hot rolled steel sheet in the transverse direction. It is considered that, by increasing the hardness at the widthwise edge in the transverse direction, the wear resistance of the steel sheet is improved, and thus, the scratches and the dent flaws are reduced.

Secondly, the present inventors have found that, in order to suppress the sheet fracture during pickling, ductile brittle transition temperature (DBTT) by a Charpy impact test is controlled to be 0° C. or less at the 25 mm position from the edge of the hot rolled steel sheet in the transverse direction. The present inventors have found that, by satisfying the above condition, the sheet fracture is favorably suppressed even in winter where the sheet fracture tends to frequently occurs in the pickling process. It is considered that, by increasing the toughness at the widthwise edge in the transverse direction, stress is relaxed at a crack tip by ductility of the steel sheet even when a small crack is initiated from the edge of the steel sheet, and thus, propagation of the crack is suppressed.

Furthermore, the present inventors have found that, in order to suppress the sheet fracture during pickling, thickness difference (crown) is controlled to be 50 μm or less between the 25 mm position from the edge of the hot rolled steel sheet in the transverse direction and a center position in the transverse direction. The present inventors have found that, by satisfying the above condition, initiation of the crack which acts as origin of the sheet fracture is suppressed when the steel sheet is passed in the pickling process, and thus, the propagation of the crack is suppressed.

For instance, the thickness at the widthwise edge in the transverse direction tends to be thinner than that at the widthwise center in the transverse direction due to degradation of rolling rolls. When the thickness at the widthwise edge becomes thin, the steel sheet at the widthwise edge tends to elongate in a longitudinal direction (rolling direction) as a serration in order to compensate for reduction in volume of the steel sheet. Thus, degree (amplitude) of the serration increases with an increase in the crown. When the serration is excessive at the widthwise edge, repeated bending and bending back are applied to the widthwise edge (especially serrated region) when the steel sheet is passed during pickling, since the serration has the amplitude. As a result, the crack which acts as origin of the sheet fracture tends to be initiated and propagated. Thus, by reducing the crown, the initiation and propagation of the crack may be suppressed, and thereby, the sheet fracture may be suppressed.

As mentioned above, the sheet fracture which occurs during pickling is mainly caused by the crack which is initiated and propagated at the widthwise edge of the steel sheet. Thus, in order to suppress the sheet fracture during pickling, features at the widthwise edge of the steel sheet may be controlled as explained above. However, the most important characteristics required for the non oriented electrical steel sheet are magnetic characteristics. For instance, when features in full width in the transverse direction are the same as those at the widthwise edge of the steel sheet explained above, it is difficult to satisfy the magnetic characteristics required for the non oriented electrical steel sheet. Thus, in order to satisfy both of stable passability in the pickling process and the magnetic characteristics for the non oriented electrical steel sheet, it is needed to respectively elaborate the features of steel sheet at the widthwise edge and the widthwise center.

In addition to controlling the features at the widthwise edge of steel sheet as explained above, the present inventors have found that, in order to satisfy both of the stable passability in the pickling process and the magnetic characteristics for the non oriented electrical steel sheet, the features at the widthwise center of the steel sheet is controlled as follows. Specifically, the present inventors have found that ΔHv which is a value obtained by subtracting a vickers hardness at the widthwise center from the vickers hardness at the widthwise edge is controlled to be 10 to 100 Hv and that ΔDBTT which is a value obtained by subtracting the ductile brittle transition temperature at the widthwise edge from a ductile brittle transition temperature at the widthwise center is controlled to be 10 to 100° C.

Based on the above findings, it is possible to obtain the hot rolled steel sheet for the non oriented electrical steel sheet which satisfies the magnetic characteristics without the sheet fracture during pickling even when the self-annealing is conducted in the hot rolling process and the hot-rolled sheet annealing is omitted.

The hot rolled steel sheet for the non oriented electrical steel sheet according to the present embodiment includes, as a chemical composition, by mass %, 0.0050% or less of C, 1.9 to 3.5% of Si, 0.10 to 1.50% of Mn, 0.10 to 1.50% of Al, and a balance consisting of Fe and impurities, wherein, when the widthwise edge is the 25 mm position from the edge of the steel sheet in the transverse direction and when the widthwise center is the center position of the steel sheet in the transverse direction, the vickers hardness at the widthwise edge is 180 Hv or more, ΔHv which is the value obtained by subtracting the vickers hardness at the widthwise center from the vickers hardness at the widthwise edge is 10 to 100 Hv, the ductile brittle transition temperature at the widthwise edge is 0° C. or less, ΔDBTT which is the value obtained by subtracting the ductile brittle transition temperature at the widthwise edge from the ductile brittle transition temperature at the widthwise center is 10 to 100° C., and the value obtained by subtracting the sheet thickness at the widthwise edge from the sheet thickness at the widthwise center is 50 μm or less.

Herein, the limitation reasons in regard to the chemical composition of the hot rolled steel sheet for the non oriented electrical steel sheet according to the embodiment are described.

<Chemical Composition of Hot Rolled Steel Sheet>

In the embodiment, the hot rolled steel sheet includes, as the chemical composition, base elements, optional elements as necessary, and the balance consisting of Fe and impurities.

0.0050% or Less of C

C deteriorates iron loss by magnetic aging. Thus, the C content is to be 0.0050% or less. The C content may be 0.0045% or less, 0.0040% or less, or 0.0035% or less. It is preferable that the C content is lower, and the lower limit thereof may be 0%. Considering industrial productivity, the C content may be more than 0%, 0.0015% or more, 0.0020% or more, or 0.0025% or more.

1.9 to 3.5% of Si

Si is an element which has an effect of increasing the electrical resistance. The Si content may be appropriately controlled on the basis of the required properties such as iron loss, magnetic flux density, and strength. However, when the Si content is less than 1.9%, the problem itself of the embodiment does not arise. On the other hand, when the Si content is more than 3.5%, the toughness decreases, and thereby, the production thereof becomes difficult. Thus, the Si content is to be 1.9 to 3.5%. The Si content is preferably more than 2.0%, and more preferably 2.2% or more.

0.10 to 1.50% of Mn

Mn is a sulfide forming element and accelerates grain growth. Thus, the lower limit of the Mn content is to be 0.10%. Also, Mn has an effect of increasing the electrical resistance. The upper limit of the Mn content may be 1.50% at which the effect is saturated.

0.10 to 1.50% of Al

Al is an element necessary for deoxidizing steel. In order to obtain a stable deoxidizing effect and suppress forming fine AlN, the Al content is to be 0.10% or more. Also, Al has an effect of increasing the electrical resistance. However, when adding excessively, castability in steelmaking deteriorates. Thus, the upper limit of the Al content is to be 1.50%.

In the embodiment, Sn may be included as an optional element. Sn has an effect of suppressing scale formed by hot rolling and increasing the magnetic characteristics. Thus, the Sn content may be 0 to 0.20% as necessary. The Sn content is preferably 0.03% or more, and is preferably 0.20% or less.

In the embodiment, P and S may be limited as impurities. P may deteriorates the toughness. Thus, the P content may be 0.020% or less as necessary. The P content is preferably 0.010% or less. S may deteriorates the toughness and the magnetic characteristics. Thus, the S content may be 0.003% or less as necessary.

The impurities are elements which do not impair the effect of the embodiment even when it is contained and correspond to elements which are contaminated during industrial production of steel sheet from ores and scrap that are used as a raw material of steel, or from environment of a production process. For instance, the upper limit of the total content of impurities may be 5%.

The chemical composition as described above may be measured by typical analytical methods for the steel. For instance, the chemical composition may be measured by using ICP-AES (Inductively Coupled Plasma-Atomic Emission Spectrometer: inductively coupled plasma emission spectroscopy spectrometry). Specifically, it is possible to obtain the chemical composition by conducting the measurement by Shimadzu ICPS-8100 or the like (measurement device) under the condition based on calibration curve prepared in advance using samples with 35 mm square taken from the steel sheet. In addition, C may be measured by the infrared absorption method after combustion.

Herein, the features at the widthwise edge and the widthwise center of the hot rolled steel sheet for the non oriented electrical steel sheet according to the embodiment are described. In addition, the widthwise edge is defined as the 25 mm position from the edge of the steel sheet in the transverse direction and the widthwise center is defined as the center position of the steel sheet in the transverse direction.

<Vickers Hardness>

In the hot rolled steel sheet for the non oriented electrical steel sheet according to the embodiment, the vickers hardness at the widthwise edge is to be 180 Hv or more. When the vickers hardness is less than 180 Hv, the scratches and the dent flaws tend to be formed, and thus, the strain tend to concentrated when the steel sheet is passed in the pickling process. The vickers hardness at the widthwise edge is preferably 190 Hv or more, and more preferably 200 Hv or more. By increasing the hardness at the widthwise edge, high hardness can be coincidently obtained at farthest edge where the scratches and the dent flaws are easily formed. The upper limit of the Vickers hardness at the widthwise edge is not particularly limited, and may be 350 Hv for instance.

Moreover, in the hot rolled steel sheet for the non oriented electrical steel sheet according to the embodiment, ΔHv which is the value obtained by subtracting the vickers hardness at the widthwise center from the vickers hardness at the widthwise edge is to be 10 to 100 Hv. When the vickers hardness satisfies the above conditions, it is possible to satisfy both of the stable passability in the pickling process and the magnetic characteristics for the non oriented electrical steel sheet. The above value is preferably 10 Hv or more, and more preferably 20 Hv or more. Also, the above value is preferably 100 Hv or less, more preferably 90 Hv or less, and more preferably 50 Hv or less.

The vickers hardness may be measured on the basis of JIS Z 2244 (2009). A measuring load may be appropriately controlled so as to obtain maximum size of indentation, and thus, the measurement can be performed with higher accuracy. For instance, the measuring load may be within $9.8\times10^{-5}$ to $9.8\times10^{0}$ N. For the measurement of the vickers hardness, the indentation size is generally measured using an optical microscope. In order to accurately measure the vickers hardness, the indentation size may be measured using an electron microscope such as SEM. The Vickers hardness may be measured at a central area in a thickness direction.

<Ductile Brittle Transition Temperature>

In the hot rolled steel sheet for the non oriented electrical steel sheet according to the embodiment, the ductile brittle transition temperature at the widthwise edge is to be 0° C. or less. When DBTT at the widthwise edge is more than 0° C., the crack tends to be initiated and propagated by the strain which is concentrated on the scratches and the dent flaws, and thus, the sheet fracture tends to be occur especially in winter when the outside temperature is low. The DBTT at the widthwise edge is preferably −5° C. or less, and more preferably −10° C. or less. The unevenness of the bottom surface of the coil caused by the irregular coiling of the coiled sheet after hot rolling is approximately 10 mm. Thus, when the toughness at the widthwise edge is increased, the crack formed at the edge of the steel sheet barely propagates toward the widthwise center. The lower limit of the DBTT at the widthwise edge is preferably lower and is not particularly limited. For instance, the DBTT may be −100° C.

Moreover, in the hot rolled steel sheet for the non oriented electrical steel sheet according to the embodiment, ΔDBTT which is the value obtained by subtracting the DBTT at the widthwise edge from the DBTT at the widthwise center is to be 10 to 100° C. When ΔDBTT satisfies the above conditions, it is possible to satisfy both of the stable passability in the pickling process and the magnetic characteristics for the non oriented electrical steel sheet. The above value is preferably 10° C. or more, and more preferably 20° C. or more. Also, the above value is preferably 100° C. or less, more preferably 90° C. or less, and more preferably 50° C. or less.

The DBTT may be obtained from results of the Charpy impact test. The Charpy impact test may be measured on the basis of JIS Z 2242 (2018). For instance, as measurement conditions, a V-shaped notch may be provided on a test piece, the impact test may be performed, and absorbed energy may be measured. Thickness of the test piece for the Charpy impact test may be the same as that of the hot rolled steel sheet.

<Crown>

In the hot rolled steel sheet for the non oriented electrical steel sheet according to the embodiment, the value (crown) obtained by subtracting the sheet thickness at the widthwise edge from the sheet thickness at the widthwise center is to be 50 μm or less. When the crown is 50 μm or less, it is possible to suppress the sheet fracture in the pickling process. The crown is preferably 40 μm or less, and more preferably 30 μm or less. The unevenness of the bottom surface of the coil caused by the irregular coiling of the coiled sheet after hot rolling is approximately 10 mm. Thus, when the crown between the widthwise edge and the widthwise center is lower, the repeated bending and bending back are barely applied, and thus, the crack formed at the edge of the steel sheet barely propagates toward the widthwise center.

The crown may be measured using a commercially available thickness meter for instance. When oxidation conditions in the transverse direction are significantly different during hot rolling and/or after coiling, the scale (surface oxidation layer) of the hot rolled steel sheet is removed by pickling or the like, and then, the crown may be measured. Alternatively, the crown may be measured with excluding influence of the scale by measuring the thickness of the steel sheet which is observed using the optical microscope or the electron microscope such as SEM after polishing a cross section of the hot rolled steel sheet.

<Producing Method of Hot Rolled Steel Sheet>

Herein, the producing method of the hot rolled steel sheet for the non oriented electrical steel sheet according to the embodiment is described.

The producing method of the hot rolled steel sheet for the non oriented electrical steel sheet according to the embodiment is for producing the hot rolled steel sheet explained above, and the method includes heating a slab to 1050 to 1180° C., the slab including, as a chemical composition, by mass %, 0.0050% or less of C, 1.9 to 3.5% of Si, 0.10 to 1.50% of Mn, 0.10 to 1.50% of Al, and a balance consisting of Fe and impurities, rough-rolling the slab after the heating, reheating a rough-rolled sheet after the rough-rolling, final-rolling the rough-rolled sheet after the reheating under conditions such that a final temperature is 900 to 1000° C., and coiling a final-rolled sheet after the final-rolling under conditions such that a coiling temperature at the widthwise edge is 700 to 800° C., and the coiling temperature at the widthwise edge is 50° C. or less as compared with a coiling temperature at the widthwise center.

Also, in the producing method of the hot rolled steel sheet for the non oriented electrical steel sheet according to the embodiment, it is preferable that the bottom surface of the coiled sheet after hot rolling is made not to contact with another coiled sheet for at least 30 minutes after the coiling.

Unless otherwise mentioned. the heating temperatures (for instance, slab heating temperature, final rolling temperature, or the like) correspond to surface temperature at the widthwise center. Also, the widthwise edge corresponds to the 25 mm position from the edge of the steel sheet in the transverse direction and the widthwise center corresponds to the center position of the steel sheet in the transverse direction.

The chemical composition of the slab is the same as the chemical composition of the hot rolled steel sheet described above. In the production of the non oriented electrical steel sheet, the chemical compositions hardly change in the processes from the slab to the obtained hot rolled steel sheet. The chemical composition of the above slab corresponds to a ferritic single phase steel in which $\alpha$-$\gamma$ transformation does not occur during the producing process.

The heating temperature of the slab is to be 1050 to 1180° C. Since high temperature strength of the ferritic single phase steel which is the target of the embodiment is low, the slab may sag when the slab heating temperature is high, and thus, the rolling may not be appropriately conducted. Thus, the slab heating temperature is to be 1180° C. or less. On the other hand, when the slab heating temperature is less than 1050° C., deformation resistance may be excessively large, and thus, it may become to conduct the rolling. Thus, the lower limit of the slab heating temperature is to be 1050° C.

Conditions for rough rolling are not particularly limited, and known conditions for rough rolling may be applied.

Since the deformation resistance of the ferritic single phase steel which is the target of the embodiment is low, the temperature during rough rolling decreases excessively. Thus, the rough-rolled sheet after rough rolling is reheated. The rough-rolled sheet after rough rolling may be reheated so that the final temperature of the final rolling is to be within the range of 900° C. to 1000° C.

The rough-rolled sheet after being reheated is final-rolled. The final rolling may be conducted under the condition such that the final temperature is to be 900° C. to 1000° C. When the final temperature is less than 900° C., it becomes difficult to control the coiling temperature at the widthwise edge to be 700° C. or more during coiling which is the post process, and it becomes difficult to control the coiling temperature at the widthwise edge to be 50° C. or less as compared with the coiling temperature at the widthwise center. Thus, the lower limit of the final temperature is to be 900° C. On the other hand, when the final temperature is more than 1000° C., the cooling ability after final rolling may be insufficient, and thus, it becomes difficult to control the coiling temperature at the widthwise edge to be 800° C. or less during coiling which is the post process. Thus, the upper limit of the final temperature is to be 1000° C.

The final rolled sheet after final rolling is coiled under conditions such that the coiling temperature at the widthwise edge is 700 to 800° C. and the coiling temperature at the widthwise edge is 50° C. or less as compared with the coiling temperature at the widthwise center.

In general, increasing the hardness of the hot rolled steel sheet and decreasing the DBTT are contradictory. However, the present inventors have found that it is possible to satisfy both of the hardness and the DBTT by decreasing the coiling temperature of the final rolled sheet so that the strain introduced into the steel sheet in the final hot rolling is appropriately remained. It is considered that the reason why it is possible to satisfy both of the hardness and the DBTT is that the hardness is increased by the residual strain and the toughness is improved by residual non-recrystallized structure which is remained due to low coiling temperature. In order to appropriately remain the strain, the coiling temperature at the widthwise edge is to be 800° C. or less. On the other hand, when the coiling temperature at the widthwise edge is less than 700° C., the residual strain becomes excessive although the hardness is further increased, and thus, the DBTT is more than 0° C. Thus, the coiling temperature at the widthwise edge is to be 700° C. or more.

Also, the coiling temperature at the widthwise edge is to be 50° C. or less as compared with a coiling temperature at the widthwise center. When the full width of the steel sheet is cooled to the same temperature as the widthwise edge, the magnetic characteristics deteriorate. In order to satisfy both of the stable passability in the pickling process and the magnetic characteristics for the non oriented electrical steel sheet, it is needed to respectively control the coiling temperatures at the widthwise edge and the widthwise center. A region from the edge to 25 mm of the steel sheet in the transverse direction is trimmed during pickling or forming a product. Thus, even when the coiling temperature at the widthwise edge is 50° C. or less as compared with a coiling temperature at the widthwise center, the magnetic characteristics of final product are not affected.

A method for controlling the coiling temperature at the widthwise edge to be 50° C. or less as compared with a coiling temperature at the widthwise center is not particularly limited. For instance, the coiling temperatures at the widthwise edge and the widthwise center may be respectively controlled by spraying a liquid such as water, by blowing gas such as air or nitrogen, or by contacting solid materials to the widthwise edge or near the edge, during hot rolling, after hot rolling, during coiling, or after coiling.

Also, in the producing method of the hot rolled steel sheet for the non oriented electrical steel sheet according to the embodiment, it is preferable that the bottom surface of the coiled sheet after hot rolling is made not to contact with another coiled sheet for at least 30 minutes after the coiling. For instance, when the coiled sheets are stacked under condition such that a core of the coil becomes a vertical hole and that the bottom surface thereof contacts with another within 30 minutes after coiling, which is called stacking, the scratches tend to be formed on the bottom surface, because the temperature of the coiled sheet after hot rolling is still high and the strength of the steel sheet is low. Moreover, when the bottom surface of the coiled sheet after hot rolling contacts with another coiled sheet, the temperature of the bottom surface of the coil rises and the strain introduced in the final hot rolling is relaxed, and thus, it becomes difficult to satisfy both of the hardness and the DBTT. Thus, it is preferable that the bottom surface of the coiled sheet after hot rolling is made not to contact with another coiled sheet for at least 30 minutes after the coiling.

The hot rolled steel sheet produced by satisfying the production conditions described above has excellent hardness and toughness. It is possible to evaluate the properties of the hot rolled steel sheet by confirming whether or not the sheet fracture occurs due to the repeated bending. For instance, a test piece with strip-shaped is prepared by shearing to a width of 30 mm and a length of 300 mm from the widthwise edge of the hot rolled steel sheet. While immersed in the 0° C. bath, the test piece is bent by 90° clockwise from 6 o'clock position to 9 o'clock position with a radius of curvature of 40 mm, bent back to 6 o'clock position, bent by 90° counterclockwise to 3 o'clock position, and bent back to 6 o'clock position. The above order is regarded as one cycle, and the number of the cycles until the test piece fractures is counted. In the hot rolled steel sheet for the non oriented electrical steel sheet according to the embodiment, the number of the above cycles is 10 or more.

EXAMPLES

The effects of an aspect of the present invention are described in detail with reference to the following examples. However, the condition in the examples is an example condition employed to confirm the operability and the effects of the present invention, so that the present invention is not limited to the example condition. The present invention can employ various types of conditions as long as the conditions do not depart from the scope of the present invention and can achieve the object of the present invention.

TABLE 1

| STEEL TYPE | CHEMICAL COMPOSITION OF SLAB (STEEL PIECE) (IN UNITS OF MASS %, BALANCE CONSISTING OF Fe AND IMPURITIES) | | | |
|---|---|---|---|---|
| | C | Si | Mn | Al |
| A1 | 0.0050 | 3.1 | 0.20 | 0.30 |
| A2 | 0.0030 | 1.9 | 0.30 | 0.30 |
| A3 | 0.0040 | 3.5 | 0.40 | 0.50 |
| A4 | 0.0020 | 3.3 | 0.10 | 0.60 |
| A5 | 0.0020 | 2.5 | 1.50 | 0.90 |
| A6 | 0.0030 | 2.2 | 1.10 | 0.10 |
| A7 | 0.0030 | 2.8 | 0.80 | 1.50 |
| A8 | 0.0020 | 2.9 | 0.20 | 0.50 |
| A9 | 0.0010 | 2.4 | 0.30 | 0.30 |
| a1 | 0.0080 | 2.1 | 0.20 | 0.40 |
| a2 | 0.0040 | 3.9 | 0.40 | 0.70 |
| a3 | 0.0030 | 2.5 | 0.04 | 0.90 |
| a4 | 0.0010 | 2.4 | 0.90 | 0.03 |
| a5 | 0.0040 | 3.2 | 0.60 | 1.90 |

TABLE 2

| HOT ROLLING | | | | | | | |
|---|---|---|---|---|---|---|---|
| | | HEATING | FINAL | COILING TEMPERATURE | | | |
| REFERENCE SIGN OF HOT ROLLING | SLAB HEATING TEMPERATURE ° C. | TEMPERATURE AFTER ROUGH ROLLING ° C. | TEMPERATURE OF FINAL ROLLING ° C. | WIDTHWISE EDGE (1) ° C. | WIDTHWISE CENTER (2) ° C. | TEMPERATURE DIFFERENCE (2) − (1) ° C. | STACKING OF COILED SHEET AFTER HOT ROLLING |
| B1 | 1050 | 1020 | 950 | 750 | 810 | 60 | NOT CONDUCTED |
| B2 | 1180 | 1010 | 900 | 770 | 840 | 70 | NOT CONDUCTED |
| B3 | 1120 | 1080 | 1000 | 790 | 860 | 70 | NOT CONDUCTED |
| B4 | 1100 | 1030 | 930 | 700 | 770 | 70 | NOT CONDUCTED |
| B5 | 1120 | 1020 | 920 | 800 | 860 | 60 | NOT CONDUCTED |
| B6 | 1060 | 1010 | 910 | 720 | 770 | 50 | NOT CONDUCTED |
| B7 | 1130 | 1000 | 940 | 730 | 790 | 60 | NOT CONDUCTED |
| B8 | 1080 | 1020 | 970 | 740 | 800 | 60 | NOT CONDUCTED |
| b1 | 1020 | NOT HOT ROLLABLE | — | — | — | — | — |
| b2 | 1210 | NOT HOT ROLLABLE | — | — | — | — | — |
| b3 | 1140 | 1100 | 1030 | 830 | 890 | 60 | NOT CONDUCTED |
| b4 | 1120 | 1080 | 800 | 670 | 710 | 40 | NOT CONDUCTED |
| b5 | 1100 | 1060 | 980 | 830 | 870 | 40 | NOT CONDUCTED |
| b6 | 1070 | 1050 | 950 | 790 | 830 | 40 | NOT CONDUCTED |
| b7 | 1080 | 1050 | 950 | 790 | 850 | 60 | CONDUCTED |
| b8 | 1090 | 1050 | 950 | 790 | 860 | 70 | CONDUCTED |
| b9 | 1180 | NOT CONDUCTED | 790 | 660 | 690 | 30 | NOT CONDUCTED |
| b10 | 1130 | 1000 | 940 | 750 | 750 | 0 | NOT CONDUCTED |
| b11 | 1100 | 1050 | 920 | 680 | 730 | 50 | NOT CONDUCTED |

Example 1

A slab with the chemical composition shown in Table 1 was hot-rolled to a thickness of 2.5 mm under production condition corresponding to a reference sign of hot rolling shown in Table 2, and a hot rolled steel sheet was coiled. In addition, the coiling temperatures at the widthwise edge and the widthwise center were respectively controlled by spraying a coolant selectively to vicinity of the widthwise edge in processes from hot rolling to coiling.

The chemical composition of the produced hot rolled steel sheet was the same as that of the slab. A test piece was cut out from the produced hot rolled steel sheet, and the Vickers hardness of the widthwise edge and the widthwise center, the ductile brittle transition temperature of the widthwise edge and the widthwise center, and the crown (thickness difference between the widthwise edge and the widthwise center of the hot rolled steel sheet) were measured on the basis of the above method.

Furthermore, test piece was prepared from the produced hot rolled steel sheet, the repeated bending test was conducted on the basis of the above method, and the number of the cycles until the test piece fractures was counted.

The produced hot rolled steel sheet was pickled, was cold-rolled to 0.5 mm, and was final-annealed to obtain the non oriented electrical steel sheet. In the pickling process, the pickling was conducted while paying attention so as not to fracture the steel sheet as necessary. A test piece was cut out from the non oriented electrical steel sheet after final annealing, and the magnetic characteristics were measured on the basis of single sheet tester (SST) method of JIS C 2556 (2015).

TABLE 3

| | | | PRODUCTION RESULTS | | | | |
|---|---|---|---|---|---|---|---|
| | | | VICKERS HARDNESS | | | DUCTILE BRITTLE TRANSITION TEMPERATURE (DBTT) | |
| | | | | | HARDNESS | | |
| No. | STEEL TYPE | REFERENCE SIGN OF HOT ROLLING | WIDTHWISE EDGE (3) Hv | WIDTHWISE CENTER (4) Hv | DIFFERENCE Δ H v (3) − (4) Hv | WIDTHWISE EDGE (5) ° C. | WIDTHWISE CENTER (6) ° C. |
| C1 | A1 | B7 | 240 | 200 | 40 | −10 | 20 |
| C2 | A2 | B7 | 180 | 150 | 30 | −30 | 0 |
| C3 | A3 | B7 | 280 | 220 | 60 | −5 | 50 |
| C4 | A4 | B7 | 260 | 210 | 50 | −5 | 35 |
| C5 | A5 | B7 | 200 | 180 | 20 | −20 | 10 |
| C6 | A6 | B7 | 210 | 170 | 40 | −15 | 5 |
| C7 | A7 | B7 | 220 | 190 | 30 | −15 | 0 |
| C8 | A8 | B7 | 230 | 200 | 30 | −15 | 0 |
| C9 | A9 | B7 | 190 | 170 | 20 | −25 | 5 |
| c1 | a1 | B7 | 210 | 180 | 30 | 0 | 10 |
| c2 | a2 | B7 | — | — | — | — | — |
| c3 | a3 | B7 | 200 | 170 | 30 | −5 | 10 |
| c4 | a4 | B7 | 200 | 170 | 30 | −10 | 10 |
| c5 | a5 | — | — | — | — | — | — |

| | PRODUCTION RESULTS | | | | |
|---|---|---|---|---|---|
| No. | DUCTILE BRITTLE TRANSITION TEMPERATURE (DBTT) ΔDBTT (6) − (5) ° C. | CROWN μm | EVALUATION RESULTS REPEATED BENDING CYCLES | NOTE | |
| C1 | 30 | 25 | 13 | — | INVENTIVE EXAMPLE |
| C2 | 30 | 30 | 15 | — | INVENTIVE EXAMPLE |
| C3 | 55 | 45 | 10 | — | INVENTIVE EXAMPLE |
| C4 | 40 | 30 | 11 | — | INVENTIVE EXAMPLE |
| C5 | 30 | 25 | 14 | — | INVENTIVE EXAMPLE |
| C6 | 20 | 40 | 16 | — | INVENTIVE EXAMPLE |
| C7 | 15 | 45 | 17 | — | INVENTIVE EXAMPLE |
| C8 | 15 | 50 | 20 | — | INVENTIVE EXAMPLE |
| C9 | 30 | 40 | 22 | — | INVENTIVE EXAMPLE |
| c1 | 10 | 30 | 13 | POOR MAGNETIC CHARACTERISTICS | COMPARATIVE EXAMPLE |
| c2 | — | — | — | NOT HOT ROLLABLE | COMPARATIVE EXAMPLE |
| c3 | 15 | 45 | 15 | POOR MAGNETIC CHARACTERISTICS | COMPARATIVE EXAMPLE |
| c4 | 20 | 45 | 16 | POOR MAGNETIC CHARACTERISTICS | COMPARATIVE EXAMPLE |
| c5 | — | — | — | NOT CASTABLE | COMPARATIVE EXAMPLE |

As shown in Table 3, the inventive examples were excellent in the repeated bending properties. Also, the inventive examples were excellent in the magnetic characteristics although not shown in the tables. On the other hand, the comparative examples did not satisfy the chemical composition or the production conditions, and thus, as least one of the productivity, the repeated bending properties, and the magnetic characteristics was unacceptable.

Although not shown in the tables, the steel type with the Si content of less than 1.9 mass % did not have the problem explained above, and thus, was not tested. Moreover, in the steel type with the Mn content of more than 1.5 mass %, the effect of containing Mn was saturated.

Example 2

A slab with the chemical composition shown in Table 1 was hot-rolled to a thickness of 2.5 mm under production condition corresponding to a reference sign of hot rolling shown in Table 2, and a hot-rolled steel sheet was coiled. In addition, the coiling temperatures at the widthwise edge and the widthwise center were respectively controlled by spraying a coolant selectively to vicinity of the widthwise edge in processes from hot rolling to coiling. Thereafter, the same evaluation as in Example 1 was conducted. The chemical composition of the produced hot rolled steel sheet was the same as that of the slab.

The produced hot rolled steel sheet was pickled, was cold-rolled to 0.5 mm, and was final-annealed to obtain the non oriented electrical steel sheet. In the pickling process, the pickling was conducted while paying attention so as not to fracture the steel sheet as necessary. Thereafter, the same evaluation as in Example 1 was conducted.

TABLE 4

| | | | PRODUCTION RESULTS | | | | |
|---|---|---|---|---|---|---|---|
| | | | VICKERS HARDNESS | | | DUCTILE BRITTLE TRANSITION TEMPERATURE (DBTT) | |
| | | | | | HARDNESS DIFFERENCE | | |
| No. | STEEL TYPE | REFERENCE SIGN OF HOT ROLLING | WIDTHWISE EDGE (3) Hv | WIDTHWISE CENTER (4) Hv | Δ H v (3) − (4) Hv | WIDTHWISE EDGE (5) ° C. | WIDTHWISE CENTER (6) ° C. |
| D1 | A8 | B1 | 220 | 190 | 30 | −10 | 0 |
| D2 | A8 | B2 | 210 | 170 | 40 | −5 | 15 |
| D3 | A8 | B3 | 200 | 160 | 40 | 0 | 10 |
| D4 | A8 | B4 | 240 | 210 | 30 | −20 | 0 |
| D5 | A8 | B5 | 230 | 160 | 70 | −10 | 15 |
| D6 | A8 | B6 | 230 | 210 | 20 | −25 | 0 |
| D7 | A8 | B7 | 230 | 200 | 30 | −15 | 0 |
| D8 | A8 | B8 | 220 | 190 | 30 | −10 | 10 |
| d1 | A8 | b1 | — | — | — | — | — |
| d2 | A8 | b2 | — | — | — | — | — |
| d3 | A8 | b3 | 170 | 160 | 10 | 15 | 20 |
| d4 | A8 | b4 | 200 | 200 | 0 | 5 | 10 |
| d5 | A8 | b5 | 170 | 170 | 0 | 20 | 20 |
| d6 | A8 | b6 | 190 | 190 | 0 | 15 | 20 |
| d7 | A8 | b7 | 170 | 160 | 10 | 50 | 30 |
| d8 | A8 | b8 | 170 | 160 | 10 | 40 | 30 |
| d9 | A8 | b9 | 210 | 210 | 0 | 5 | 10 |
| d10 | A8 | b10 | 220 | 220 | 0 | −10 | −10 |
| d11 | A8 | b11 | 200 | 180 | 20 | 5 | 10 |
| d12 | A8 | B7 | 230 | 200 | 30 | −15 | 0 |

| | PRODUCTION RESULTS | | | | |
|---|---|---|---|---|---|
| No. | DUCTILE BRITTLE TRANSITION TEMPERATURE (DBTT) ΔDBTT (6) − (5) ° C. | CROWN μm | EVALUATION RESULTS REPEATED BENDING CYCLES | NOTE | |
| D1 | 10 | 30 | 17 | — | INVENTIVE EXAMPLE |
| D2 | 20 | 50 | 13 | — | INVENTIVE EXAMPLE |
| D3 | 10 | 40 | 10 | — | INVENTIVE EXAMPLE |
| D4 | 20 | 40 | 25 | — | INVENTIVE EXAMPLE |
| D5 | 25 | 50 | 15 | — | INVENTIVE EXAMPLE |
| D6 | 25 | 40 | 30 | — | INVENTIVE EXAMPLE |
| D7 | 15 | 50 | 20 | — | INVENTIVE EXAMPLE |
| D8 | 20 | 40 | 17 | — | INVENTIVE EXAMPLE |
| d1 | — | — | — | NOT HOT ROLLABLE | COMPARATIVE EXAMPLE |
| d2 | — | — | — | NOT HOT ROLLABLE | COMPARATIVE EXAMPLE |
| d3 | 5 | 40 | 7 | — | COMPARATIVE EXAMPLE |
| d4 | 5 | 40 | 5 | POOR MAGNETIC CHARACTERISTICS | COMPARATIVE EXAMPLE |
| d5 | 0 | 50 | 6 | POOR MAGNETIC CHARACTERISTICS | COMPARATIVE EXAMPLE |

TABLE 4-continued

| | | | | | |
|---|---|---|---|---|---|
| d6 | 5 | 40 | 7 | POOR MAGNETIC CHARACTERISTICS | COMPARATIVE EXAMPLE |
| d7 | −20 | 50 | 3 | — | COMPARATIVE EXAMPLE |
| d8 | −10 | 50 | 4 | — | COMPARATIVE EXAMPLE |
| d9 | 5 | 40 | 5 | POOR MAGNETIC CHARACTERISTICS | COMPARATIVE EXAMPLE |
| d10 | 0 | 40 | 16 | POOR MAGNETIC CHARACTERISTICS | COMPARATIVE EXAMPLE |
| d11 | 5 | 40 | 5 | — | COMPARATIVE EXAMPLE |
| d12 | 15 | 70 | 4 | POOR HOT ROLLING ROLL | COMPARATIVE EXAMPLE |

As shown in Table 4, the inventive examples were excellent in the repeated bending properties. Also, the inventive examples were excellent in the magnetic characteristics although not shown in the tables. On the other hand, the comparative examples did not satisfy the chemical composition or the production conditions, and thus, as least one of the productivity, the repeated bending properties, and the magnetic characteristics was unacceptable.

In the table, "poor hot rolling roll" indicates that the thickness at the widthwise edge became thinner than that at the widthwise center due to degradation of rolling rolls.

INDUSTRIAL APPLICABILITY

According to the above aspects of the present invention, it is possible to provide the hot rolled steel sheet for the non oriented electrical steel sheet which achieves stable passability without fracture of the steel sheet in the pickling process, and the producing method thereof. In addition, according to the above aspects of the present invention, it is possible to suppress scratches and dent flaws at an edge in the transverse direction of the coiled sheet after hot rolling. Accordingly, the present invention has significant industrial applicability.

The invention claimed is:

1. A hot rolled steel sheet for a non oriented electrical steel sheet, the hot rolled steel sheet comprising, as a chemical composition, by mass %, 0.0050% or less of C, 1.9 to 3.5% of Si, 0.10 to 1.50% of Mn, 0.10 to 1.50% of Al, and a balance consisting of Fe and impurities, wherein, when a widthwise edge is a 25 mm position from an edge of a steel sheet in a transverse direction and when a widthwise center is a center position of the steel sheet in the transverse direction, a vickers hardness at the widthwise edge is 180 Hv or more, ΔHv which is a value obtained by subtracting a vickers hardness at the widthwise center from the vickers hardness at the widthwise edge is 10 to 100 Hv, a ductile brittle transition temperature at the widthwise edge is 0° C. or less, ΔDBTT which is a value obtained by subtracting the ductile brittle transition temperature at the widthwise edge from a ductile brittle transition temperature at the widthwise center is 10 to 100° C., and a value obtained by subtracting a sheet thickness at the widthwise edge from a sheet thickness at the widthwise center is 50 μm or less.

2. A producing method of the hot rolled steel sheet for the non oriented electrical steel sheet according to claim 1, the method comprising heating a slab to 1050 to 1180° C., the slab including, as a chemical composition, by mass %, 0.0050% or less of C, 1.9 to 3.5% of Si, 0.10 to 1.50% of Mn, 0.10 to 1.50% of Al, and a balance consisting of Fe and impurities, rough-rolling the slab after the heating, thereby producing a rough-rolled sheet, reheating the rough-rolled sheet after the rough-rolling, final-rolling the rough-rolled sheet after the reheating under conditions such that a final temperature is 900 to 1000° C., and coiling the final-rolled sheet after the final-rolling under conditions such that a coiling temperature at the widthwise edge is 700 to 800° C., and the coiling temperature at the widthwise edge is 50° C. or less as compared with a coiling temperature at the widthwise center.

3. The producing method of the hot rolled steel sheet for the non oriented electrical steel sheet according to claim 2, wherein a bottom surface of the coiled sheet after hot rolling is made not to contact with another coiled sheet for at least 30 minutes after the coiling.

4. A hot rolled steel sheet for a non oriented electrical steel sheet, the hot rolled steel sheet comprising, as a chemical composition, by mass %, 0.0050% or less of C, 1.9 to 3.5% of Si, 0.10 to 1.50% of Mn, 0.10 to 1.50% of Al, and a balance comprising Fe and impurities, wherein, when a widthwise edge is a 25 mm position from an edge of a steel sheet in a transverse direction and when a widthwise center is a center position of the steel sheet in the transverse direction, a vickers hardness at the widthwise edge is 180 Hv or more, ΔHv which is a value obtained by subtracting a vickers hardness at the widthwise center from the vickers hardness at the widthwise edge is 10 to 100 Hv, a ductile brittle transition temperature at the widthwise edge is 0° C. or less, ΔDBTT which is a value obtained by subtracting the ductile brittle transition temperature at the widthwise edge from a ductile brittle transition temperature at the widthwise center is 10 to 100° C., and a value obtained by subtracting a sheet thickness at the widthwise edge from a sheet thickness at the widthwise center is 50 μm or less.

5. A producing method of the hot rolled steel sheet for the non oriented electrical steel sheet according to claim 4, the method comprising heating a slab to 1050 to 1180° C., the slab including, as a chemical composition, by mass %, 0.0050% or less of C, 1.9 to 3.5% of Si, 0.10 to 1.50% of Mn, 0.10 to 1.50% of Al, and a balance comprising Fe and impurities, rough-rolling the slab after the heating, thereby producing a rough-rolled sheet, reheating the rough-rolled sheet after the rough-rolling, final-rolling the rough-rolled sheet after the reheating under conditions such that a final temperature is 900 to 1000° C., and coiling the final-rolled sheet after the final-rolling under conditions such that a coiling temperature at the widthwise edge is 700 to 800° C., and the coiling temperature at the widthwise edge is 50° C. or less as compared with a coiling temperature at the widthwise center.

* * * * *